US008752589B2

(12) United States Patent
Kiest, Jr.

(10) Patent No.: US 8,752,589 B2
(45) Date of Patent: Jun. 17, 2014

(54) METHOD AND APPARATUS FOR REPAIRING THE WALL OF A MANHOLE

(75) Inventor: Larry W. Kiest, Jr., Ottawa, IL (US)

(73) Assignee: LMK Technologies, LLC, Chicago, IL (US)

( * ) Notice: Subject to any disclaimer, the term of this patent is extended or adjusted under 35 U.S.C. 154(b) by 374 days.

(21) Appl. No.: 12/959,044

(22) Filed: Dec. 2, 2010

(65) Prior Publication Data

US 2012/0141210 A1 Jun. 7, 2012

(51) Int. Cl.
*F16L 55/16* (2006.01)

(52) U.S. Cl.
USPC ..... 138/98; 138/97; 405/184.2

(58) Field of Classification Search
USPC ..... 138/98, 97; 405/184.2
See application file for complete search history.

(56) References Cited

U.S. PATENT DOCUMENTS

| | | | | |
|---|---|---|---|---|
| 5,397,513 | A * | 3/1995 | Steketee, Jr. | 264/36.17 |
| 5,762,450 | A | 6/1998 | Schmager | |
| 6,167,913 | B1 * | 1/2001 | Wood et al. | 138/98 |
| 6,401,759 | B1 * | 6/2002 | Kamiyama et al. | 138/98 |
| 6,478,054 | B1 | 11/2002 | Kiest | |
| 6,520,719 | B1 * | 2/2003 | Tweedie et al. | 405/184.2 |
| 6,540,438 | B2 * | 4/2003 | De Bruijn et al. | 405/150.1 |
| 7,669,614 | B2 * | 3/2010 | Cohen | 138/98 |
| 7,670,086 | B2 * | 3/2010 | Kiest et al. | 405/184.2 |
| 7,841,366 | B2 * | 11/2010 | Bryant et al. | 138/98 |
| 2004/0149341 | A1 * | 8/2004 | Driver | 138/98 |
| 2004/0156682 | A1 * | 8/2004 | Blackmore et al. | 405/184.1 |
| 2006/0188339 | A1 * | 8/2006 | De Bruijn et al. | 405/150.1 |
| 2008/0047624 | A1 * | 2/2008 | Iwasaki-Higbee | 138/98 |
| 2008/0277838 | A1 | 11/2008 | Hassen et al. | |
| 2009/0194184 | A1 * | 8/2009 | Kiest, Jr. | 138/98 |
| 2010/0018631 | A1 * | 1/2010 | Kiest et al. | 156/94 |
| 2010/0301505 | A1 * | 12/2010 | Kiest, Jr. | 264/36.16 |
| 2011/0297243 | A1 * | 12/2011 | Kiest, Jr. | 137/15.08 |

FOREIGN PATENT DOCUMENTS

WO WO2006/128256 A1 12/2006

* cited by examiner

*Primary Examiner* — James Hook
(74) *Attorney, Agent, or Firm* — McKee, Voorhees & Sease, P.L.C.

(57) ABSTRACT

The present invention comprises a method and means for repairing the wall of a manhole wherein a material capable of curing and hardening is adhered to the wall. An expandable bladder engages the curable and hardenable material and presses against and smoothes the material. The bladder may be chemically bonded to the curable and hardenable material or it may be mechanically bonded.

45 Claims, 9 Drawing Sheets

METHOD AND APPARATUS FOR REPAIRING THE WALL OF A MANHOLE

BACKGROUND OF THE INVENTION

This invention relates to a method and apparatus for repairing the wall of a manhole. More particularly, but not exclusively, it relates to a method and device for treating the wall of a manhole using a bladder and material capable of curing and hardening, such as a grout or thermoset resin. The bladder expands to conform to the wall of the manhole and the material capable of curing and hardening is disposed between the wall and the bladder or on the interior surface of the bladder.

Conventional manholes include a lower or bottom panel, a barrel having a relatively constant diameter adjacent the panel, a concentric or eccentric cone extending upwardly from the barrel, one or more adjusting rings to adjust the overall height of the manhole, and a casting frame on top of the adjusting rings to support an elevation substantially level with the surrounding pavement. The casting frame is preferably sealed to the uppermost adjusting ring to preclude or minimize water flow into the manhole. The cone and adjusting rings are commonly known as the manhole chimney. Most manhole structures are unique in size and shape with varying diameters and depths. Also, bricks often form a portion of the wall of the manhole.

Substandard construction methods can lead to damage or deterioration of the manhole structure. Thus the manhole is vulnerable, allowing water and subsidence of soil to enter the manhole, which eventually leads to a structural failure of the manhole.

One presently known method of repairing manholes is the placement of a coating of a cementitious grout onto the interior surface of the manhole wall. The grout is applied in an uncured state and is permitted to cure. Methods of applying the grout include troweling the grout onto the wall of the manhole after spraying or slinging the grout onto the wall of the manhole. The manhole wall must be clean and free from water leaking through the manhole walls. Here, it is necessary for a person to enter into the manhole to plug water leaking into the manhole. A final troweling step is usually required by a person entering the manhole in order to obtain the desired compaction, surface and thickness for the curable and/or hardenable material.

Additionally, resin, such as an epoxy, a polyurethane, polyuria or other thermo-set resins have been applied to manhole walls by spraying or slinging the polymer onto the manhole wall. The polymer requires the manhole wall to be clean and free from water leaking with a prepared surface adequate for adhering the polymer to the manhole wall.

Resin-coated sleeves have also been used for repairing a manhole chimney. However, to accommodate changes in diameter of the manhole, the use of an impermeable coating on the sleeve is problematic, as a substantial coating can prohibit the necessary stretching of the sleeve, because when the sleeve stretches, the coating becomes prone to delamination from the sleeve. Furthermore, applying a coating to a fabric sleeve and sealing the seam of a fabric sleeve increases the cost for producing the sleeve. As such, problems remain in the art and a need exists for an improved method and means for repairing the wall of a manhole.

BRIEF SUMMARY OF THE INVENTION

It is therefore a principal object, aspect, feature or advantage of the present invention to provide an apparatus and method for repairing the wall of a manhole which improves over or solves the problems and deficiencies in the art.

Other objects, features, aspects, and/or advantages of the present invention relate to an apparatus and method which achieves the desired compaction, surface and thickness for the curable and hardenable material without troweling or otherwise requiring an operator to enter the manhole.

Further objects, features, aspects, and/or advantages of the present invention relate to a new method of repairing the wall of a manhole wherein the curable and hardenable material is applied to the wall and an impermeable coating is applied to the outer surface of the material.

Further objects, features, aspects, and/or advantages of the present invention relate to a new apparatus and method for repairing the wall of a manhole wherein an impermeable coating is mechanically bonded to the grout or other curable and hardenable material.

Still further objects, features, aspects, and/or advantages of the present invention relate to a new method of repairing the interior wall of a manhole wherein an impermeable coating is formed about the manhole wall and adhered thereto with a chemical bond, or in some cases a mechanical and a chemical bond.

Still further objects, features, aspects, and/or advantages of the present invention relate to a new method of repairing the interior wall of a manhole wherein a resin impregnated sleeve does not include an impermeable coating maximizing stretching of the sleeve, forming an impermeable coating to the resin impregnated sleeve by adhering an inflatable bladder to the resin impregnated sleeve as the resin cures.

A still further object, feature, aspect and/or advantage of the present invention relates to a method and apparatus for repairing the wall of the manhole that accommodates diameter changes along the wall.

Further objects, features, aspects, and/or advantages of the present invention relate to a method and apparatus for repairing the wall of a manhole wherein a pressurized, expandable bladder provides a clean dry surface onto which a curable and hardenable material is applied.

These and other objects, features, aspects, and/or advantages of the present invention will become apparent with reference to the accompanying specification and claims.

One aspect of the invention includes a method for repairing a wall of a manhole that obviates the need for a pre-formed liner. The method generally includes applying a material capable of curing and hardening to the wall of the manhole, positioning a bladder at least partially within the manhole, expanding the bladder under pressure against the wall of the manhole, allowing the material to cure and harden, and removing the bladder from the manhole.

In another aspect of the invention, a resin impregnated sleeve may optionally be used and the bladder is left within the manhole after the curing process. A bond is created between the resin and an exterior surface of the bladder after the resin impregnated sleeve is applied to the wall of the manhole and is allowed to cure and harden. In one form, the exterior surface of the bladder is uneven and adapted to be mechanically attached to the cured resin impregnated sleeve. In another form, the bladder is compatible for adhesion with the cured resin impregnated sleeve. Once the material cures and hardens, a mechanical bond and/or a chemical bond are created between the resin impregnated sleeve applied to the wall and the inflation bladder. The bladder is left bonded to the material on the wall of the manhole to create an impermeable coating.

Another aspect of the present invention includes a method of repairing a wall of a manhole wherein a bladder is positioned at least partially within the manhole and expanded under pressure against the wall of the manhole. A material capable of curing and hardening is then applied to the interior surface of the manhole and allowed to cure and harden. The bladder provides both an impermeable barrier and a clean dry surface on which to apply the curable and hardenable material.

Yet another aspect of the present invention relates to an apparatus for treating a wall of a manhole that includes a material capable of curing and hardening covering the wall of the manhole, a bladder is expanded outwardly with an exterior surface of the bladder being attached to the material on the wall of the manhole and wherein the exterior surface of the bladder creates a mechanical bond, a chemical bond, or both a chemical and mechanical bond with the material on the wall of the manhole.

In an alternative form, the apparatus includes a bladder expanded outwardly against the wall of the manhole and the material capable of curing and hardening covers an interior surface of the bladder.

The present invention as disclosed herein provides numerous advantages. For example, once a grout or other material capable of curing and hardening is applied to the wall of the manhole, no troweling by hand or similar operation is required to provide for the proper compaction, surface and thickness of the material. A pre-formed liner is not required to practice the invention. In embodiments wherein the bladder is not removed from the wall of the manhole, the bladder effectively becomes an impermeable barrier or coating to the manhole lining.

Still further yet, in those embodiments wherein the material capable of curing and hardening is sprayed or otherwise applied to the interior of an expanded bladder within the manhole, the bladder provides a clean surface onto which to adhere the material in addition to an impermeable barrier.

Still further yet, the use of an expandable bladder to press a curable and hardenable material against and into cracks and crevices in the wall of the manhole provides for a structurally sound repair not heretofore possible with the prior art spraying and troweling method.

These and other benefits and advantages of the invention will become apparent to those skilled in the art based on the following disclosure.

DETAILED DESCRIPTION OF THE PREFERRED EMBODIMENT

Figure 1:
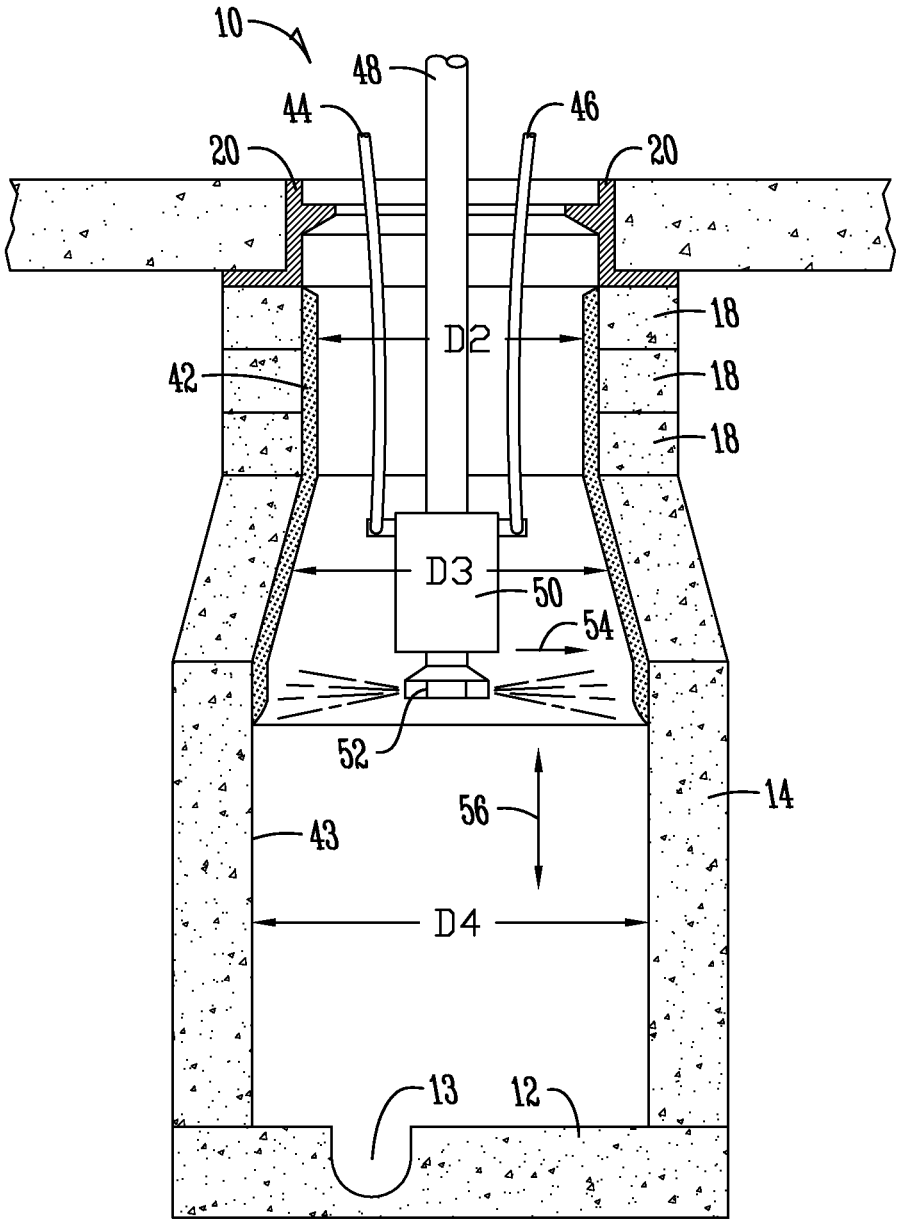
FIG. 1 is a sectional view of a manhole including a sprayer for applying a curable and/or hardenable material onto the manhole walls.

A typical manhole 10 has a bottom panel 12 that has a run through 13. The bottom panel 12 is attached to a barrel 14, a cone section 16, and a plurality of adjusting rings 18. A casting frame 20 is mounted at the upper end of the manhole 10. As can be seen in FIGS. 1, 2, 3, 10, 12, and 13, the manhole 10 has a number of diameters D1, D2, D3, and D4, as well as irregularities in the wall usually formed of brick, which often become spaced from one another.

FIG. 1 shows the initial manhole 10. A curable and/or hardenable material 42 is sprayed on the wall of the manhole 10 by a sprayer 50. The material capable of curing and hardening may be a grout, a resin, a thermoset resin, a photocuring resin, or a cementious material. Sprayer 50 has an inside air supply 44 and an outside air supply 46, which cause sprayer ribs 52 to rotate and throw the curable and/or hardenable material 42 outwardly in the direction of arrow 54. The sprayer 50 has a feeder 48 which extends downwardly through sprayer 50. The arrow 56 shows the movement of sprayer 50 in an upward and downward direction. A cementitious grout is preferred, but various construction grouts and resinous materials are suitable for use with the present invention, including resin grouts and thermoset resins such as epoxy resin.

Figure 2:
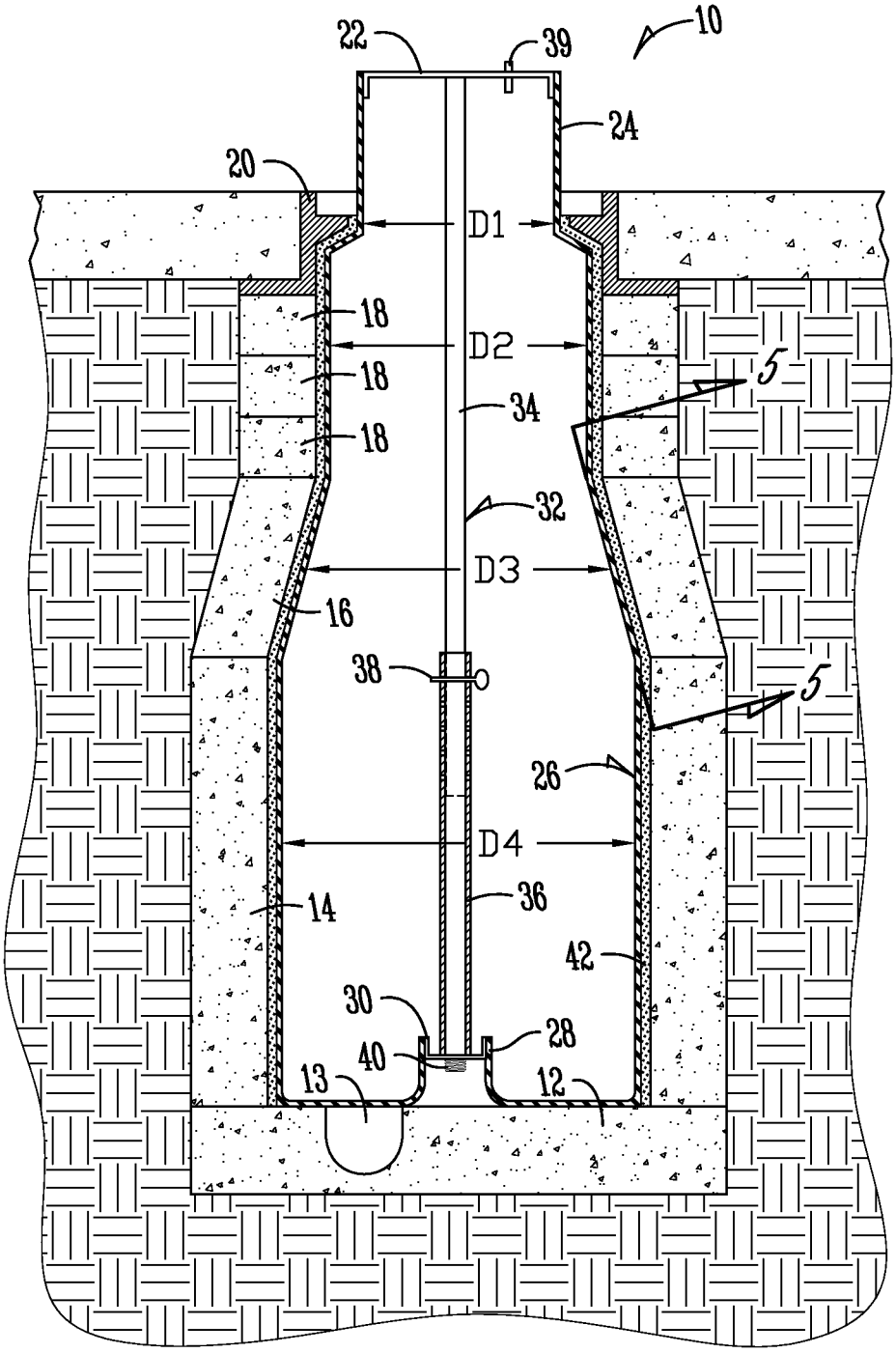
FIG. 2 is a sectional view of a manhole where an installation assembly is used in accordance with an embodiment of the present invention.
Figure 3:
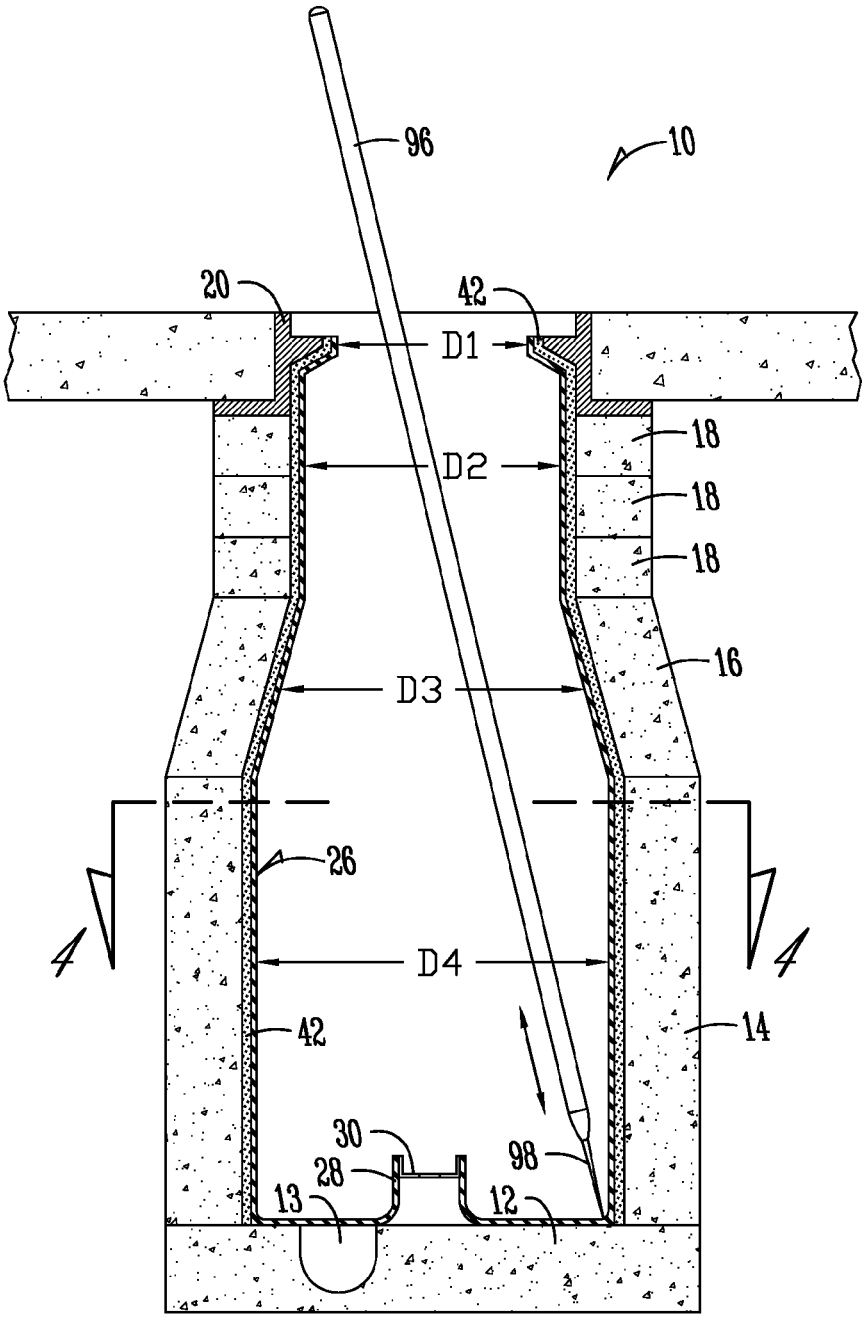
FIG. 3 is a sectional view of the manhole in FIG. 1, showing a second view of the preferred embodiment of the present invention.
Figure 4:
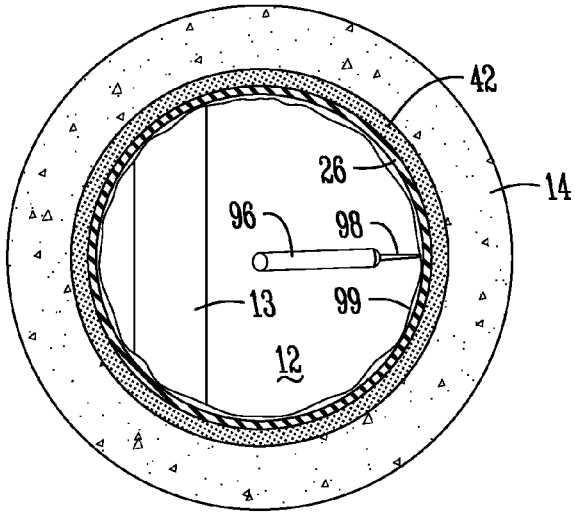
FIG. 4 is a sectional view according to line 4-4 of FIG. 3.

FIGS. 2-4 show an embodiment of the invention. Attached to an upper rack 22 is the upper end 24 of an expandable bladder 26 which extends to a lower end 28. The lower end 28 of the bladder 26 is attached to a lower rack 30. The lower rack 30 is attached to the upper rack 22 by a post 32 that has a post section 34 telescopically received within a post section 36, which has a pin 38 securing the post sections 34, 36 together. There may be other post sections in addition to post sections 34, 36. A threaded end 40 is within the lower most post section 36 so as to secure the post 32 to the lower rack 30. Alternatively, the bladder 26 may be attached to the upper rack 22 at the upper end 24 of the bladder 26, and the lower end 28 of the bladder 26 may be closed by banding or otherwise sealing the lower end 28. In such an alternative, the lower rack 30 and post 32 need not be used to install the bladder 26 into manhole 10.

The bladder 26 is self-contained and therefore inflatable. The bladder 26 may generally be described as an inflatable, expandable, non-absorbent, fluid impervious film. The bladder 26 is preferably made of thermoplastic polyurethane or another thermoplastic material such as poly vinyl chloride or polypropylene. The bladder material should have a wall thickness of approximately 20-100 mils prior to expansion, which thins to approximately 10-80 mils when expanded against the wall. It is also preferable that the bladder not have a scrim reinforcement, so that the bladder can expand or stretch as necessary to accommodate changes in diameter of the manhole. As such, the bladder 26 may have a single, uniform diameter. With such a bladder, the diameter may be sized to be equal or less than the smallest cross section found within the manhole 10, which is typically defined by the casting frame 20 and adjusting rings 18.

An air inlet tube 39 extends through the upper rack 22 and is adapted to introduce air to inflate the bladder 26. The air inlet tube 39 or a separate inlet may be used to introduce steam or another heated fluid when thermoset resins are used. Alternatively, a UV light may be integrated into the upper rack 22 so as to extend into the bladder 26.

Figure 5:
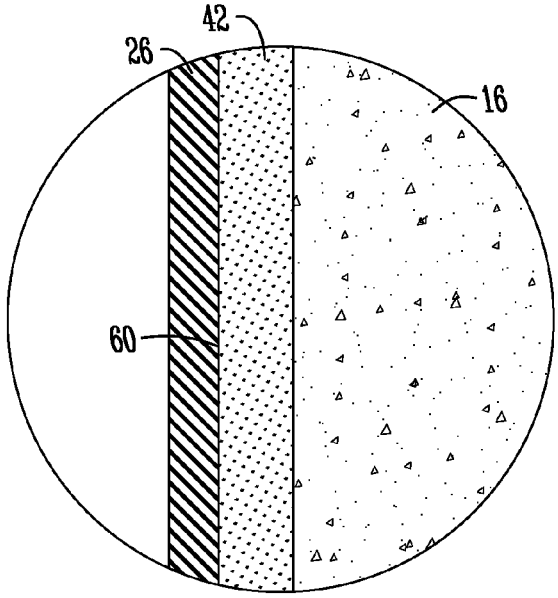
FIG. 5 is a sectional view according to line 5-5 of FIG. 2.
Figure 6:
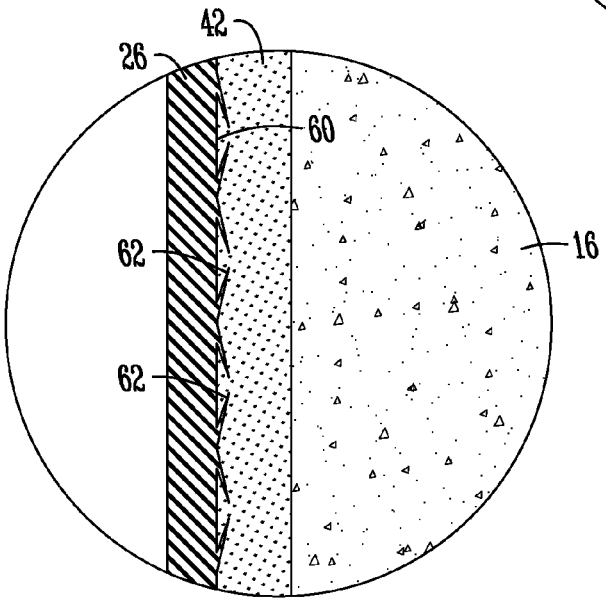
FIG. 6 is a sectional view similar to FIG. 5 of a modification of the present invention.
Figure 7:
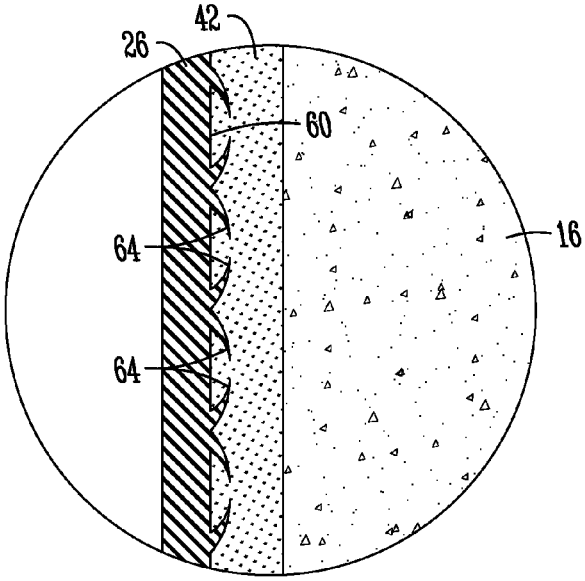
FIG. 7 is a sectional view similar to FIG. 5 of a further modification of the present invention.
Figure 8:
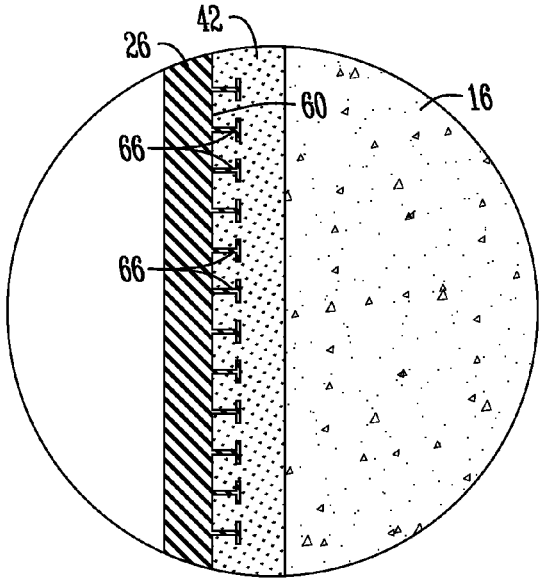
FIG. 8 is a sectional view similar to FIG. 5 showing a further modification of the present invention.

FIG. 5 shows the bladder 26 with an exterior surface 60 in contact with a curable and/or hardenable material 42. As shown in FIG. 5, there are no projections extending from the bladder 26 into the curable and/or hardenable material 42, and consequently there is no mechanical bond. However a chemical bond exists between the bladder 26 and the curable and/or hardenable material 42 upon the curing and hardening of the material, forming an impermeable coating or barrier that becomes an integral part of the manhole. In order to exploit this feature of the invention, it is preferred to use a bladder material that is compatible for adhesion with the curable and hardenable material. A preferred combination to create a chemical bond is the use of an epoxy as the curable and hardenable material and the use of thermoplastic polyurethane as the bladder material. However, other combinations are within the scope of this invention. The bladder 26 as illustrated in FIGS. 6-9 is intended for use in applications where the bladder 26 remains fixed to the curable and/or hardenable material 42 after it cures and hardens, thus becoming an impermeable coating or barrier by a mechanical bond. Here, the exterior surface 60 is uneven and preferably includes a plurality of projections or protrusions. Referring to FIG. 6, a surface 60 of the bladder 26 includes straight pointed projections 62 extending in opposite directions and embedded in curable and/or hardenable material 42. FIG. 7 shows a plurality of curved pointed projections 64, and FIG. 8 illustrates T-shaped projections 66. All of these projections 62, 64 and 66 provide a mechanical bond between the bladder 26 and the curable and/or hardenable material 42, as the projections become embedded and trapped within the curable and/or hardenable material 42 once the curable and/or hardenable material cures and hardens. Projections having other shapes can be used to create a mechanical bond between the bladder 26 and curable and/or hardenable material 42.

The projections depicted in FIGS. 6-8 may be formed when the bladder material is made by an extrusion process. In such a process, raw material for forming the bladder is extruded through a series of rollers and allowed to set. At least one of the rollers may be embossed with a texture to impart the projections onto the material.

Figure 9:
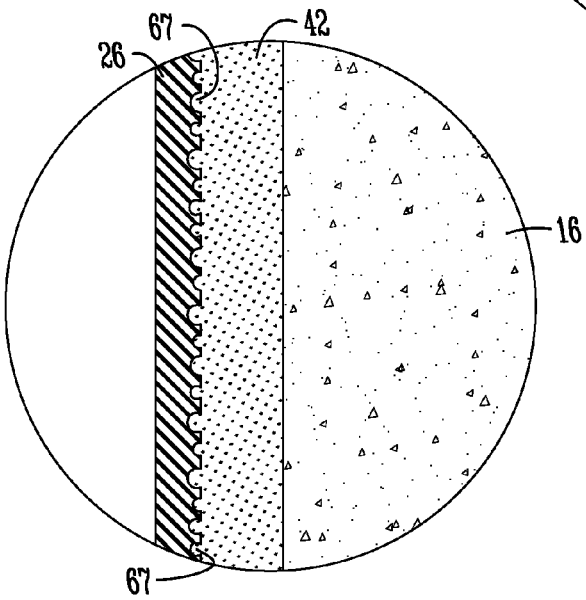
FIG. 9 is a sectional view showing yet a further modification of the present invention.

FIG. 9 illustrates an alternative embodiment of the bladder 26 that is intended for use in applications where the bladder 26 remains fixed to the curable and/or hardenable material 42 after it cures and hardens, thus becoming an impermeable coating or barrier via a mechanical bond. In this embodiment, the mechanical bond is formed by the use of pores 67 within the bladder 26. The pores 67 may be formed within the bladder material by an extrusion process or like as described above, or the pores 67 may be formed by stretching or abrading the material of the bladder 26. The stretching may be performed by inflation and expansion of the bladder 26 after placement within the manhole. In operation, the pores 67 are formed within the material of the bladder 26. The bladder 26 is expanded against a manhole wall. As the material of the bladder 26 stretches, the pores 67 open to accommodate the flow of curable and hardenable material within the pores 67. The curable and hardenable material cures within the pores 67 and anchors the material of the bladder 26 to the wall of the manhole.

The method of repair illustrated in FIGS. 1-4 is as follows. First, the manhole 10 is sprayed by sprayer 50, such as shown in FIG. 1. The sprayer 50 is passed upwardly and downwardly as shown by arrow 56 until the surface area of the wall 43 is covered. The thickness may vary depending upon the condition of the manhole 10.

The installation assembly, comprising the upper rack 22, the optional lower rack 30, and the bladder 26, is inserted into the manhole 10 with the post 32 threaded into the lower rack 30. Initially the bladder 26 hangs loose within the manhole 10 and is not in contact with the curable and/or hardenable material 42. The bladder 26 is then inflated by introduction of a fluid into the fluid intake 39. Because the bladder 26 is expandable, it moves into contact with the curable and/or hardenable material 42 as shown in FIG. 2. The fluid can be hydraulic fluid, water, or air, and could be other fluids as well.

The bladder 26 presses against the curable and/or hardenable material 42 so as to smooth it and also to cause the curable and/or hardenable material 42 to press against the number of diameters D1, D2, D3, and D4 (as well as other diameters) and to penetrate cracks and crevices in the wall of the manhole 10. This is superior to troweling, which cannot achieve the same penetration of the curable and/or hardenable material 42. Troweling also requires the operator to enter the manhole 10. With the present method of operation, it is not necessary for an operator to enter the manhole 10.

The curable and/or hardenable material is then cured and hardened within the manhole 10. The curable and/or hardenable material may be cured by the accepted method known for curing the material. For example, the curable and/or hardenable material may be cured by the use of introducing steam within the bladder 26 for a thermoset resin or the introduction of a UV light or the like for a photocuring resin. Once the curable and/or hardenable material 42 has cured and hardened, the bladder 26 may be entirely removed from the manhole 10 or the portion contacting the curable and/or hardenable material 42 may be left in place. In applications where the bladder 26 is removed, it is preferable to use a non-stick bladder material as disclosed in U.S. Patent Publication No. 2009/0194183, which is incorporated herein by reference in its entirety. In such an embodiment, no projections or protrusions should be disposed on the exterior surface of the bladder 26 to ensure the bladder 26 does not stick to the curable and/or hardenable material 42. Using this particular repair or treatment method, the curable and/or hardenable material is smoothed and penetrates cracks and crevices in the wall of the manhole 10. However, it is preferred to leave the bladder 26 within the manhole 10 to use it as an impermeable coating or barrier. Here, the bladder 26 is cut adjacent the upper end 24 and the post is unthreaded from its attachment to lower rack 30. The installation assembly, including the upper and lower rack 22, 30 and the post 32, is removed from the manhole 10 to form the manhole lining.

This leaves the manhole 10 as shown in FIG. 3. A handle 96 with a knife 98 is inserted and the knife 98 cuts the bottom of the bladder 26 into a circular cutout 99. The excess bladder material is removed from the bottom of the manhole 10, and the resulting manhole 26 is shown in FIG. 4. The handle 96 may or may not be utilized, as it allows an operator to stand outside of the manhole while cutting and removing excess material. Alternatively, the operator can enter the manhole 10 to cut and remove excess material. Alternatively, a saw, grinding tool, sander, or other cutting tool may be used to remove or smooth excess or unneeded portions of the bladder and cured material. It should also be noted that the FIGS. 3-4 illustrate where the bottom of the bladder is cut out around the periphery of the floor of the manhole 10. However, the lining of the entire manhole floor need not be removed. As such, the knife 98 or other cutting tool may simply be used to remove the lower rack 30 and to reinstate access to the run through 13. Similarly, the knife 98 or other cutting tool may be used to remove excess bladder and other material extending above the casting frame 20 of the manhole 10 after installation of the manhole lining.

Figure 10:
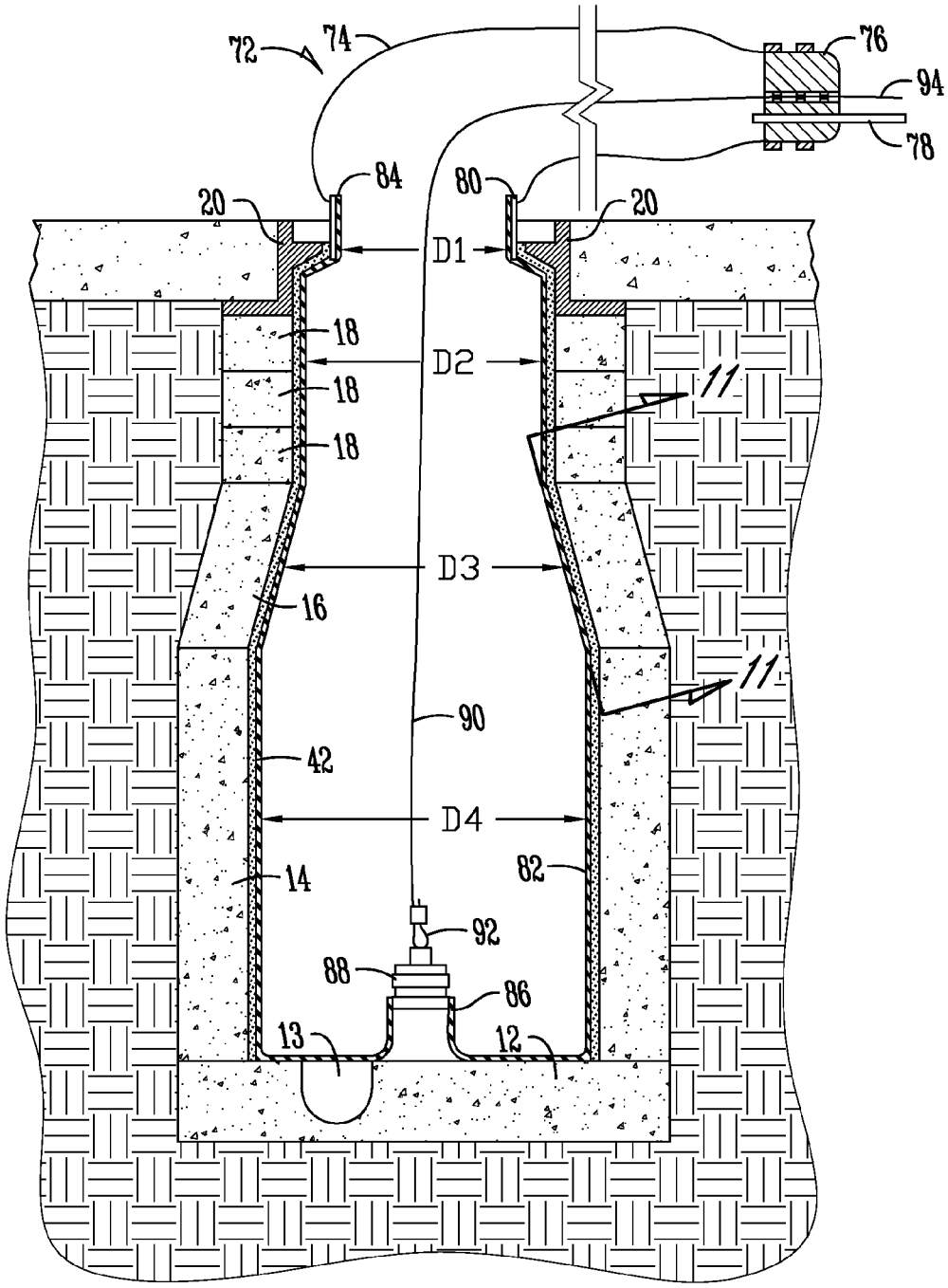
FIG. 10 is a sectional view of the manhole of FIG. 1 showing another embodiment of the installation assembly of FIG. 2.
Figure 11:
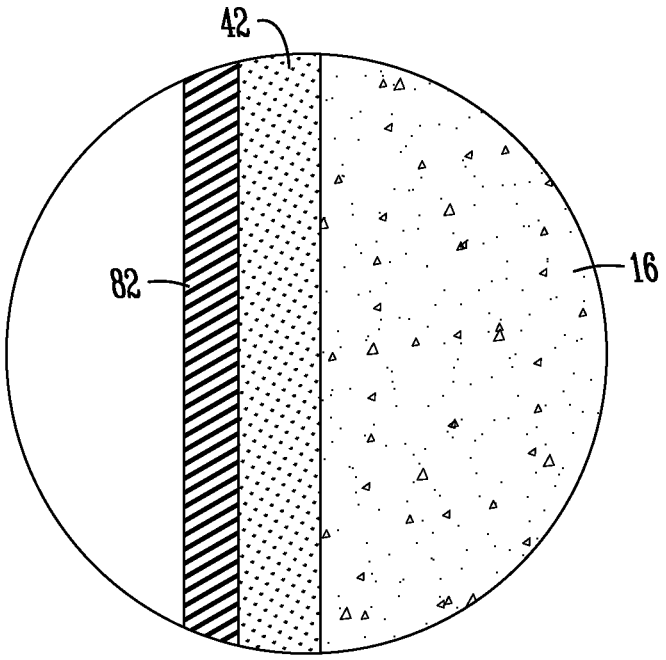
FIG. 11 is a sectional view according to line 11-11 of FIG. 10.

As an alternative to positioning the stretchable material or bladder 26 in the manhole and then expanding it radially outwardly toward the manhole wall, it may also be inverted into the manhole. This is illustrated in FIG. 10 wherein an inverter 72 is self-contained within an above ground inverter 74, and a bladder 82 is within the above ground inverter 74 and is reversed with its outside presented inwardly and its inside presented outwardly.

A plug 76 is inserted within and attached to the above ground inverter 74. The plug 76 contains a fluid introducer 78 and a pull rope 90 having a lower end 92 and an upper end 94. The upper end 94 extends through a hole in the plug 76. Fluid introducer 78 may be used to introduce steam or another heated fluid where thermoset resins are used. In such an application, the use of a heated fluid will permit or encourage curing and/or hardening of the thermoset resin. Alternatively, a separate inlet or port may be integrated into the plug 76 to accommodate the use of a heated fluid.

A rigid ring 80 is placed within the casting frame 20 and an upper end 84 of the bladder 82 is attached to the rigid ring 80. A lower end 86 of the bladder 82 is attached to a pull device 88. The lower end 92 of the pull rope 90 is attached to the pull device 88 for embodiments where the bladder 82 is removed from the manhole 10. The pull rope 90 may also be utilized for embodiments where the bladder 82 is left within the manhole 10. In such applications, the pull rope 90 may be marked at the upper end 94 prior to the inversion process so that a technician may be able to determine when the bladder 26 is fully inverted into the manhole.

The bladder 82 is reversed or inverted into the manhole 10 with its inside presented outwardly and its outside presented inwardly. The inversion can be caused by a fluid (either gas, air, or hydraulics) that is introduced by the fluid introduction device 78. The bladder 82 expands into contact with the curable and/or hardenable material 42. If a photocuring resin is used with a UV light or the like, then the bladder 82 should be made from a translucent or semi-transparent material (as known in the art). This allows a UV light to be lowered into the manhole for curing.

The bottom portion of the bladder 82 can be cut out (as previously described) and removed from the manhole 10 by pulling on the end 94 of rope 90. The remaining portion of the bladder 82 is left within the manhole 10. The same modifications as shown in FIGS. 5-8 can be applied to the bladder 82 and the curable and/or hardenable material 42 to create a chemical bond 61 or a mechanical bond or both. Again, the inflatable bladder 82 or other stretchable material acts as a coating on the curable and/or hardenable material 42.

Figure 12:
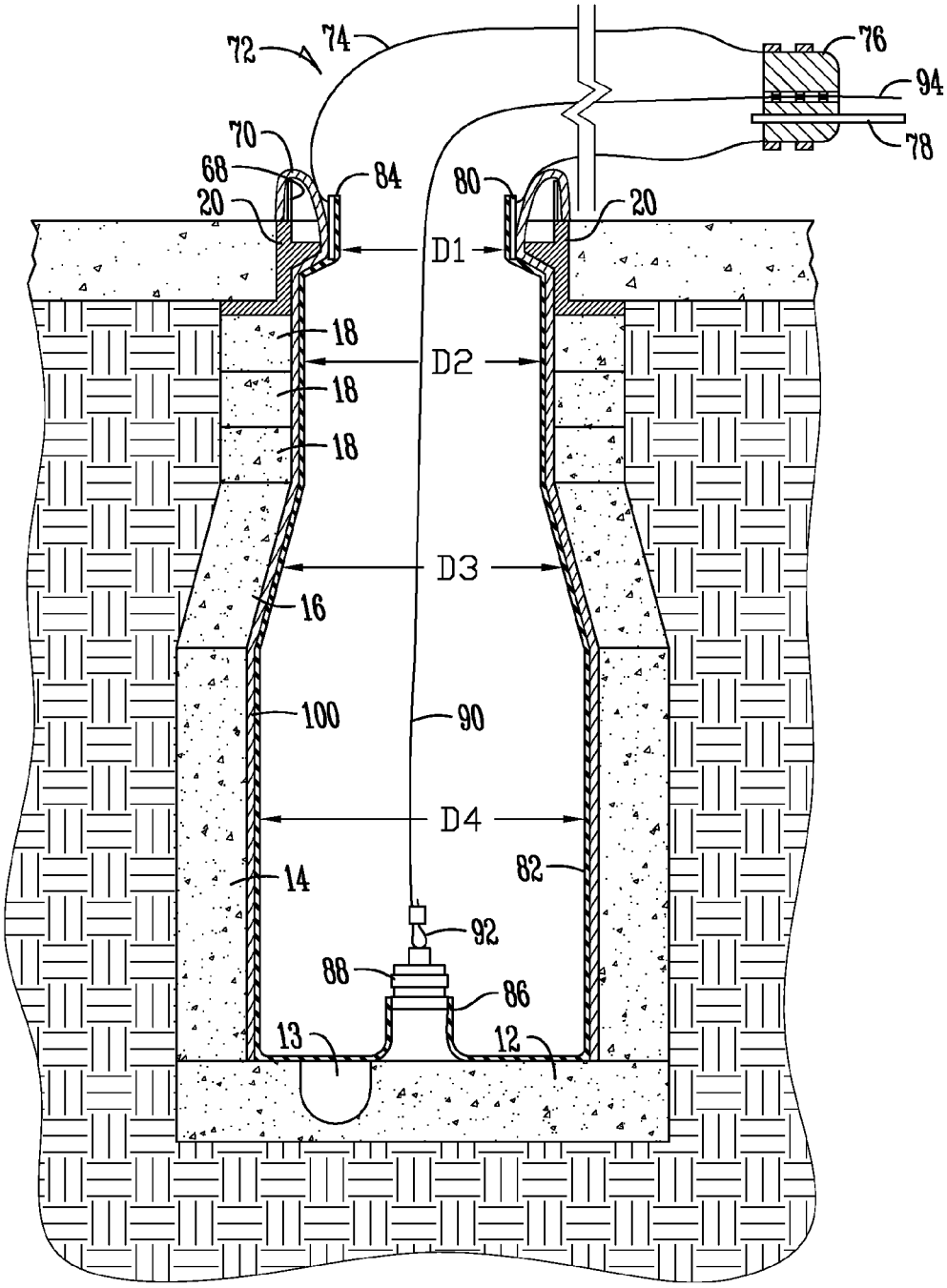
FIG. 12 is a sectional view of a manhole illustrating an alternative embodiment of the present invention.

A second embodiment is illustrated in FIG. 12. In this embodiment, a manhole liner 100 is used as an alternative to the sprayer 50 and the bladder 82 is left in the manhole 10 to create an impermeable barrier on the walls of the manhole 10. The manhole liner 100 is generally a fabric capable of being impregnated with a curable and hardenable material. The manhole liner 100 may be a stretchable sleeve that can be used to repair and renew manholes having various sizes. In one embodiment, the manhole liner 100 is a one-size fabric liner which stretches circumferentially to various diameters up to 150% of the unstretched diameter for use in manholes of varying sizes and shapes. U.S. Pat. No. 7,670,086 and U.S. Pat. App. No. 2010/0018631 describe such liners and are incorporated by reference in their entireties.

Where the bladder 82 is to be left within the manhole 10 by the use of a chemical bond, the bladder 82 is preferably constructed of a polyurethane and the curable and hardenable material is preferably an epoxy. However, other combinations of bladder material and material capable of curing and hardening are considered for use as long as they are compatible and conducive for adhesion. Where the use of a mechanical bond is desired, the material of the bladder 82 should include the projections or pores as described above.

In operation of the second embodiment, the manhole liner 100 is impregnated with a material capable of curing and hardening. The manhole liner 100 is then placed into the manhole 10 by attaching an upper portion 70 of the manhole liner 100 to a flange member 68 above the manhole 10, adjacent the casting frame 20. The manhole liner 100 is then inserted into the manhole 10 and placed against the walls of the manhole 10 by a bladder 82 that is used to expand the manhole liner 100 against the walls of the manhole. In the embodiment depicted in FIG. 12, the bladder 82 is inverted into the manhole 10 by attaching the bladder 82 to an above ground inverter 74, inserting the plug 76, and providing a fluid to the bladder 82 using fluid introducer 78. The pull rope 90 may be used to measure the depth of the bladder 82 as described above. The material capable of curing and hardening is allowed to cure and harden, providing a lining to the manhole 10 where the manhole liner 100, the cured and hardened material, and the bladder 82 become an integral part of the manhole 10. In embodiments where a chemical bond between the bladder 82 and the curable and/or hardenable material is desired, steam or heat may be introduced into the manhole 10 during the curing process to promote integration of the bladder 82 to the material capable of curing and/or hardening. Once the material is fully cured and/or hardened, areas of the lining that are unnecessary are cut away and removed from the manhole 10.

It should be noted that FIG. 12 shows where the bladder 82 is placed into the manhole 10 by the use of an inversion process for the bladder 82 after the manhole liner 100 is attached to the casting frame 20 of the manhole 10 by the use of a flange member 68. However, an inversion process is not required to practice this embodiment of the invention. Alternatively, the installation assembly as described in reference to FIG. 2 may be used to press the manhole liner 100 against the manhole walls. It should also be noted that all methods of the present invention should not be limited to the order of the recited steps. For instance, the manhole liner 100 may be impregnated with the material capable of curing and hardening before being placed into the manhole 10. Alternatively, the material capable of curing and hardening may be placed onto the manhole walls, and the manhole liner 100 may be impregnated by the material capable of curing and hardening after insertion into the manhole 10.

Figure 13:
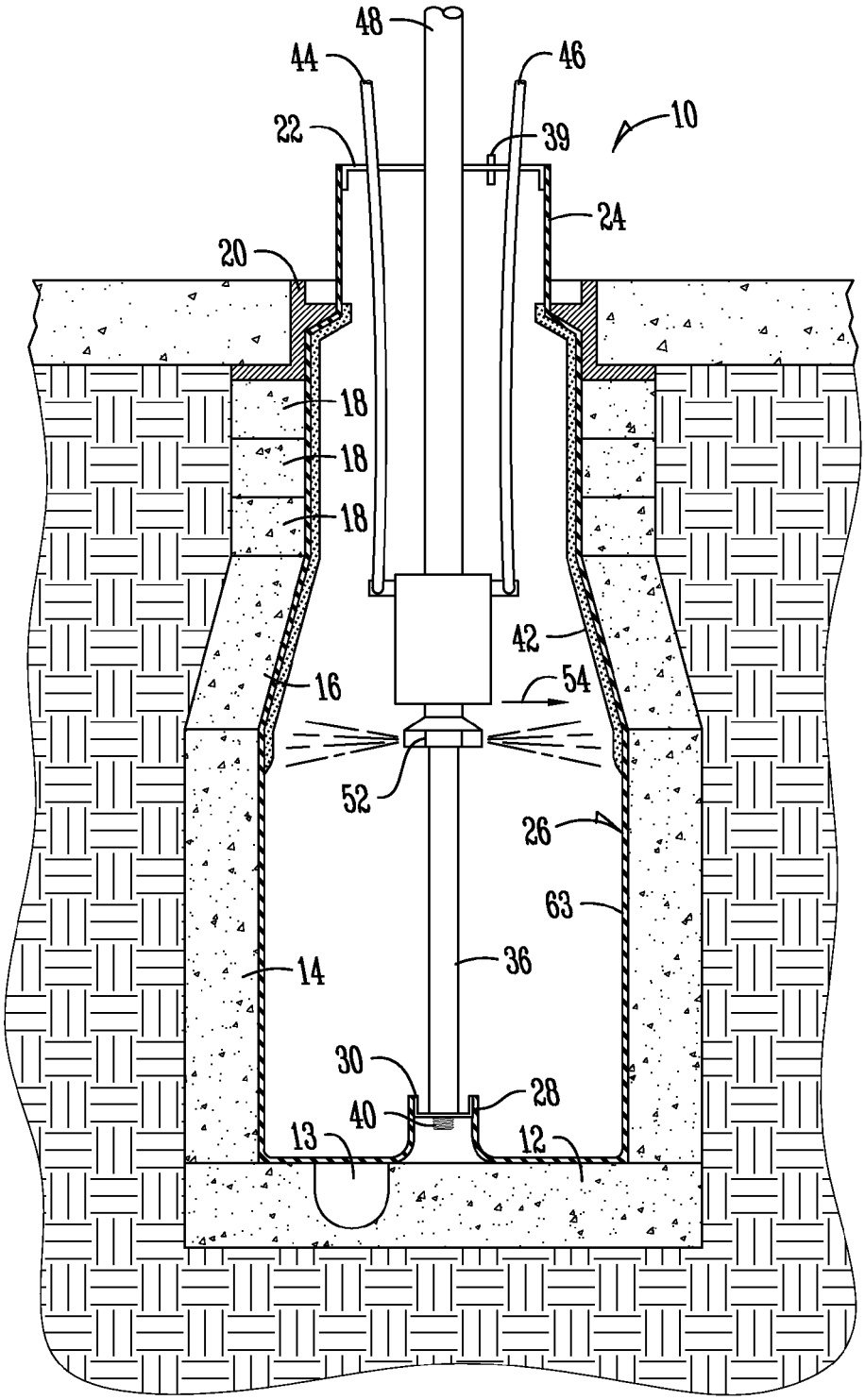
FIG. 13 is a sectional view of a manhole illustrating an alternative embodiment of the present invention.

An alternative embodiment is illustrated in FIG. 13. Here, the bladder 26 is inflated and expanded against the wall of the manhole 10 prior to applying a curable and/or hardenable material 42. The curable and/or hardenable material 42 is applied to the interior surface 63 of the bladder 26 while the bladder is maintained under pressure and conforms to the wall of the manhole 10. The curable and/or hardenable material 42 is then allowed to cure and harden, and portions of the bladder 26 are cut out and removed as previously described. In the illustrated embodiment, the sprayer is adapted to be an integral part of the installation assembly and the spray ribs 52 are movable along the post 36 between the lower rack 30 and the upper rack 22.

This alternative embodiment has several advantages. The bladder 26, preferably made of TPU with a wall thickness of 20-100 mils prior to expansion, provides a clean dry surface on which the curable and/or hardenable material is applied. The bladder also provides an impermeable barrier against the wall of the manhole that prevents ground water from washing away the curable and/or hardenable material and entering the manhole.

The invention has been shown and described above with the several embodiments, and it is understood that many modifications, substitutions, and additions may be made which are within the intended spirit and scope of the invention. From the foregoing, it can be seen that the present invention accomplishes at least all of its stated objectives.

What is claimed is:

1. A method of forming a lining to a manhole comprising:
introducing a material capable of curing and hardening to a wall of the manhole without the use of a resin absorbent liner;
positioning an inflatable bladder within the manhole during or after the introduction of the material to the wall; and
forming a bond between the inflatable bladder and the material capable of curing and hardening against the wall of the manhole.

2. The method of claim 1 wherein the bond is a chemical bond.

3. A method of claim 2 wherein the bladder is sized equal to or less than the smallest diameter of the manhole.

4. The method of claim 2 wherein the material capable of curing and hardening comprises an epoxy.

5. The method of claim 4 wherein the bladder comprises a thermoplastic polyurethane.

6. The method of claim 1 wherein the bond comprises a mechanical bond.

7. The method of claim 6 wherein the mechanical bond is formed by a plurality of projections on a surface of the bladder protruding the material capable of curing and hardening.

8. The method of claim 7 wherein the projections are hook-like shaped projections.

9. The method of claim 6 wherein the mechanical bond is formed by a plurality of pores on a surface of the bladder filling with the material capable of curing and hardening.

10. The method of claim 1 further comprising:
positioning a manhole liner between the bladder and the material capable of curing and hardening that has been introduced to the wall of the manhole; and
expanding the bladder against the wall of the manhole.

11. The method of claim 10 wherein the manhole liner stretches circumferentially to various diameters up to approximately 150% of an unstretched diameter of the manhole liner.

12. A manhole repaired according to the method of claim 11.

13. A manhole repaired according to the method of claim 1.

14. The method of claim 1 wherein the material capable of curing and hardening is introduced to the wall of the manhole by spraying the material to the wall.

15. A method for repairing a wall of a manhole that obviates the need for a resin absorbent liner, the method comprising:
applying a material capable of curing and hardening to the wall of the manhole without the use of a resin absorbent liner;
positioning a bladder at least partially within the manhole during or after the application of the material to the wall;
expanding the bladder under pressure against the material on the wall of the manhole;
allowing the material to cure and harden; and
removing the bladder from the manhole.

16. The method of claim 15 wherein the material capable of curing and hardening is a grout.

17. The method of claim 16 wherein the grout is a cementious grout.

18. The method of claim 15 wherein the material capable of curing and hardening is a thermoset resin.

19. The method of claim 15 wherein the material capable of curing and hardening is an epoxy resin.

20. The method of claim 15 wherein the material capable of curing and hardening is a urethane resin.

21. The method of claim 15 wherein the step of expanding the bladder against the material on the wall of the manhole creates a smooth surface on the material.

22. The method of claim 15 wherein the step of expanding the bladder against the material on the wall of the manhole compresses the material.

23. A manhole repaired according to the method of claim 22.

24. The method of claim 15 wherein the bladder is a translucent bladder and the material on the wall of the manhole cures and hardens with exposure to an ultra violet light.

25. The method of claim 24 further comprising introducing ultra violet light to cause the material on the wall of the manhole to cure and harden.

26. The method of claim 15 wherein the step of applying the material capable of curing and hardening to the wall of the manhole comprises spraying the material to the wall.

27. A method for repairing a wall of a manhole that obviates the need for a resin absorbent liner while providing an impermeable coating to the wall of the manhole, the method comprising:
applying a material capable of curing and hardening to the wall of the manhole without the use of a resin absorbent liner;
taking a bladder having an interior surface and an exterior surface;
positioning the bladder at least partially within the manhole during or after the application of the material to the wall of the manhole;
expanding the bladder under pressure against the material on the wall of the manhole;
allowing the material to cure and harden to create a bond with the exterior surface of the bladder;
depressurizing the bladder; and
leaving at least a portion of the bladder bonded to the material on the wall of the manhole to create an impermeable coating.

28. The method of claim 27 wherein the exterior surface of the bladder includes a plurality of projections adapted to mechanically bond the bladder to the material on the wall of the manhole after the material cures and hardens.

29. The method of claim 28 wherein the projections are hook-like shaped projections.

30. The method of claim 27 wherein the material capable of curing and hardening is a cementious grout.

31. The method of claim 27 wherein the material capable of hardening is a thermoset resin.

32. The method of claim 27 wherein the material is an epoxy resin.

33. The method of claim 27 wherein the bladder chemically bonds to the material on the wall of the manhole after the material cures and hardens.

34. A manhole repaired according to the method of claim 33.

35. The method of claim 27 wherein the bladder is a translucent bladder and the material on the wall of the manhole cures and hardens with exposure to an ultra violet light.

36. A manhole repaired according to the method of claim 35.

37. The method of claim 35 further comprising introducing ultra violet light to cause the material on the wall of the manhole to cure and harden.

38. The method of claim 27 wherein the material cures and hardens to create both a chemical and mechanical bond with the exterior surface of the bladder.

39. The method of claim 27 wherein the step of applying the material capable of curing and hardening to the wall of the manhole comprises spraying the material to the wall.

40. A method for repairing a wall of manhole that obviates the need for a resin absorbent liner while providing an impermeable coating to the wall of the manhole, the method comprising:

applying a material capable of curing and hardening to the wall of the manhole without the use of a resin absorbent liner;

positioning a bladder at least partially within the manhole during or after the application of the material to the wall of the manhole;

expanding the bladder under pressure against the material on the wall of the manhole;

allowing the material to cure and harden to create a bond with the bladder;

depressurizing the bladder; and leaving at least a portion of the bladder bonded to the material on the wall of the manhole to create an impermeable coating.

41. A method of repairing a wall of a manhole comprising:

positioning a bladder at least partially within the manhole, the bladder having an interior surface and an exterior surface;

expanding the bladder under pressure against the wall of the manhole;

applying a material capable of curing and hardening to the interior surface of the bladder without the use of a resin absorbent liner; and allowing the material to cure and harden;

wherein the bladder provides an impermeable barrier and a substantially clean surface on which to apply the material.

42. The method of claim 41 wherein the wall of the manhole has changes in diameter.

43. The method of claim 41 wherein the material capable of curing and hardening is applied to the interior surface of the bladder by spraying.

44. The method of claim 41 wherein the material is a grout.

45. The method of claim 41 wherein the material is a thermoset resin.

* * * * *